US012680479B1

(12) United States Patent
Backus et al.

(10) Patent No.: US 12,680,479 B1
(45) Date of Patent: Jul. 14, 2026

(54) CLOSED BRAYTON CYCLE SHUTDOWN CONTROL WITH VALVE SYSTEM FOR THERMALLY ISOLATING ELECTRICAL COMPONENTS

(71) Applicant: Rolls-Royce North American Technologies Inc., Indianapolis, IN (US)

(72) Inventors: Neil Backus, Indianapolis, IN (US); Michael Monzella, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 0 days.

(21) Appl. No.: 19/086,050

(22) Filed: Mar. 20, 2025

(51) Int. Cl.
*F01K 25/00* (2006.01)
*F01K 3/18* (2006.01)
*F01K 13/02* (2006.01)

(52) U.S. Cl.
CPC ..... *F01K 25/00* (2013.01); *F01K 3/181* (2013.01); *F01K 13/02* (2013.01)

(58) Field of Classification Search
CPC ..... F01K 25/00; F01K 3/181; F01K 13/02
See application file for complete search history.

(56) References Cited

U.S. PATENT DOCUMENTS 3,864,919 A 2/1975 Frutschi
4,293,384 A * 10/1981 Weber ..... G21D 9/00 376/391
4,761,957 A 8/1988 Eberhardt et al.
5,165,239 A 11/1992 Bechtel et al.
5,799,490 A 9/1998 Bronicki et al.
9,752,462 B1 9/2017 Fletcher
11,396,826 B2 7/2022 Bollinger et al.
11,480,067 B2 10/2022 Truong
11,499,474 B2 11/2022 Michalik et al.
11,680,472 B2 6/2023 Zhong et al.
(Continued)

FOREIGN PATENT DOCUMENTS

CN 109677639 B 8/2020
GB 2612836 A 5/2023
TW 1547634 B 9/2016

OTHER PUBLICATIONS

NASA, Power Conversion Technology for Fission Systems, Jul. 7, 2023, 65 pages.

(Continued)

*Primary Examiner* — Shafiq Mian
(74) *Attorney, Agent, or Firm* — Barnes & Thornburg

(57) ABSTRACT

A power-generation system includes an electrical system, a turbine engine, and a fluid control system. The turbine engine includes a compressor configured to receive and compress a working fluid, a heat source that transfers heat to the compressed working fluid, a turbine fluidly connected with the compressor to extract work from the heated working fluid and drive rotation of the compressor, and a first heat-exchanger fluidly connected with the turbine to transfer heat away from the heated working fluid to provide a cooled working fluid. The fluid control system fluidly is connected with the electrical system and the turbine engine to circulate the working fluid through the electrical system and the turbine engine.

20 Claims, 3 Drawing Sheets

(56) References Cited

U.S. PATENT DOCUMENTS

| | | | | |
|---|---|---|---|---|
| 11,885,244 | B2 | 1/2024 | Bollinger et al. | |
| 11,927,130 | B2 | 3/2024 | Apte et al. | |
| 11,982,227 | B2 | 5/2024 | Homison | |
| 11,982,228 | B2 | 5/2024 | Bollinger et al. | |
| 12,012,902 | B2 | 6/2024 | Apte et al. | |
| 12,123,347 | B2 | 10/2024 | Bollinger et al. | |
| 12,173,643 | B2 | 12/2024 | Bollinger et al. | |
| 2005/0097896 | A1 | 5/2005 | Critchley et al. | |
| 2010/0050639 | A1 | 3/2010 | Janus et al. | |
| 2010/0064688 | A1 | 3/2010 | Smith | |
| 2011/0262269 | A1 | 10/2011 | Lior | |
| 2015/0240665 | A1 | 8/2015 | Stapp | |
| 2019/0178111 | A1 | 6/2019 | Uechi et al. | |
| 2020/0191051 | A1 | 6/2020 | Homison et al. | |
| 2022/0029454 | A1 | 1/2022 | Sweet et al. | |
| 2022/0252006 | A1* | 8/2022 | Michalik | F02C 1/04 |
| 2023/0155388 | A1 | 5/2023 | Fernando | |
| 2025/0353601 | A1* | 11/2025 | Kilchyk | B64D 13/08 |

OTHER PUBLICATIONS

NASA, Closed Brayton Cycle Power Conversion Unit for Fission Surface Power Phase I Final Report, Jun. 1, 2010, 75 pages.

* cited by examiner

CLOSED BRAYTON CYCLE SHUTDOWN CONTROL WITH VALVE SYSTEM FOR THERMALLY ISOLATING ELECTRICAL COMPONENTS

FIELD OF THE DISCLOSURE

The present disclosure relates generally to closed Brayton cycle power-generation systems, and more specifically to controlling the temperature of electrical hardware that is powered by such systems.

BACKGROUND

Brayton cycle power-generation systems may be used to power spacecraft, aircraft, watercraft, and power generators. Conventional power-generation systems include a turbine engine having a compressor configured to compress a working fluid, a heat source for heating the compressed working fluid, and a turbine that extracts work from the heated compressed working fluid to power a fan, shaft, generator, etc. Power-generation systems may be open loop or closed-loop.

In some systems, the heat from the heat source is transferred to the working fluid with a heat exchanger such that no combustion products travel through the compressor or the turbine. This may allow externally-heated gas turbine engines to operate with fuel sources that may ordinarily damage or are not compatible with the internal components of the system. In closed Brayton cycle systems, the working fluid is recirculated through the compressor, the heat exchanger, and the turbine. In open Brayton cycle systems, new working fluid may be continuously introduced to the compressor.

The components of the power-generation system, including electrical systems powered by the turbine engine, generate heat during operation. There remains interest in controlling a temperature of the components and electrical systems in Brayton cycle power-generation systems to avoid overheating of the components.

SUMMARY

The present disclosure may comprise one or more of the following features and combinations thereof.

A power-generation system may comprise an electrical system, a turbine engine, and a fluid control system. The fluid control system may be fluidly connected with the electrical system and the turbine engine to circulate working fluid through the electrical system and the turbine engine.

In some embodiments, the electrical system may include a motor-generator and an electric power conditioning and distribution system connected with the motor-generator. The motor-generator may be operable in a power-generation mode to produce electrical energy and a motor mode to convert the electrical energy into rotational power. The electrical system may be configured for fluid cooling for removing heat from the electrical system.

In some embodiments, the turbine engine may include a compressor, a reactor heat-exchanger downstream of the compressor, a turbine downstream of the reactor heat-exchanger, and a cooling heat-exchanger downstream of the turbine. The compressor may be configured to receive the working fluid and compress the working fluid to provide a compressed working fluid. The reactor heat-exchanger may transfer heat from a nuclear reactor to the compressed working fluid to provide a heated working fluid. The turbine may be configured to extract work from the heated working fluid and drive rotation of the compressor and the motor-generator. The cooling heat-exchanger may transfer heat away from the heated working fluid to provide a cooled working fluid.

In some embodiments, the fluid control system may include a first valve located upstream of the electrical system, a second valve located downstream of the electrical system, and a controller coupled to the first valve and the second valve. The first valve and the second valve may each be configured to change between an open position and a closed position. In the open position, the first valve and the second valve may allow the cooled working fluid to flow into and out of the electrical system to transfer heat from the motor-generator and the power conditioning and distribution system. In the closed position, the first valve and the second valve may block the working fluid from flowing into and out of the electrical system.

In some embodiments, the controller may be configured to direct the first valve and the second valve to change from the open position to the closed position in response to a shutdown of the turbine engine in which a speed of the compressor and the turbine is below a predetermined speed. The controller may direct the first and second valve to change to the closed position in response to the shutdown of the turbine engine to trap a first portion of the working fluid between the first valve and the second valve so that the electrical system is isolated from a second portion of the working fluid in the system to prevent the electrical system from being exposed to a high-temperature of the second portion of the working fluid after the shutdown. In some embodiments, the power-generation system may be a closed-loop system such that the working fluid is recirculated through the power-generation system.

In some embodiments, the first valve may be fluidly connected upstream of the electrical system and downstream of the cooling heat-exchanger. In some embodiments, the first valve may be fluidly connected upstream of the cooling heat-exchanger.

In some embodiments, the second valve may be fluidly connected downstream of the electrical system and upstream of the compressor. In some embodiments, the second valve may be fluidly connected downstream of the compressor.

In some embodiments, the motor-generator may be coupled with the turbine engine The motor-generator may be configured to operate in the motor mode to start the turbine engine. The motor-generator may be configured to operate in the power-generation mode to be driven by the turbine and generate the electrical energy.

According to another aspect of the present disclosure, a power-generation system may comprise an electrical system, a turbine engine, and a fluid control system. The turbine engine may include a compressor, a heat source, a turbine engine, and a first heat-exchanger. The compressor may be configured to receive a working fluid and compress the working fluid to provide a compressed working fluid. The heat source may transfer heat to the compressed working fluid to provide a heated working fluid. The turbine may be fluidly connected with the compressor to extract work from the heated working fluid and drive rotation of the compressor. The first heat-exchanger may be fluidly connected with the turbine to transfer heat away from the heated working fluid to provide a cooled working fluid.

In some embodiments, the fluid control system may include a valve system and a controller coupled to the valve system. The controller may be configured to move the valve system between an open mode and a closed mode. In the open mode, the valve system may allow the cooled working fluid to flow through the electrical system in response to operation of the turbine engine. In the closed mode, the valve system may block the working fluid from flowing through the electrical system in response to a shutdown of the turbine engine.

In some embodiments, the controller may be configured to direct the valve system to be in the open mode at a start-up of the turbine engine. The controller may direct the valve system to be in the open mode at the start-up of the turbine engine to allow the working fluid to flow through the system.

In some embodiments, the valve system may include a first valve. The first valve may be fluidly connected upstream of the electrical system and downstream of the first heat-exchanger. In some embodiments, the valve system includes a first valve. The first valve may be fluidly connected upstream of the first heat-exchanger.

In some embodiments, the valve system may further include a second valve. The second valve may be fluidly connected downstream of the electrical system and upstream of the compressor. In some embodiments, the valve system may further include a second valve fluidly connected downstream of the compressor.

In some embodiments, the electrical system may include a motor-generator coupled with the compressor. The motor-generator may be configured to operate in a motor mode to start the turbine engine. The motor-generator may be configured to operate in a power-generation mode to be driven by the turbine and generate electrical energy.

According to another aspect of the disclosure, a method of operating a power-generation system may comprise compressing a working fluid with a compressor, heating the compressed working fluid, rotating a turbine with the heated working fluid, and cooling the heated working fluid after rotating the turbine with the heated fluid. The method may further include conducting electrical energy to at least one electrical component, cooling at least one electrical component with the cooled working fluid, and conducting the working fluid from the at least one electrical component to the compressor.

In some embodiments, the method may further comprise blocking the working fluid from flowing to the electrical component in response to a speed of the compressor and the turbine being below a predetermined speed. The step of blocking the working fluid from flowing to the at least one electrical component may include shutting a first valve fluidly connected upstream of the at least one electrical component and downstream of the turbine. In some embodiments, the step of blocking the working fluid from flowing to the at least one electrical component may include shutting a second valve fluidly connected downstream of the at least one electrical component and upstream of the turbine.

In some embodiments, the method may further comprise driving a generator. The method may include driving a generator with the work extracted from the turbine to produce the electrical energy.

These and other features of the present disclosure will become more apparent from the following description of the illustrative embodiments.

DETAILED DESCRIPTION OF THE DRAWINGS

Figure 1:
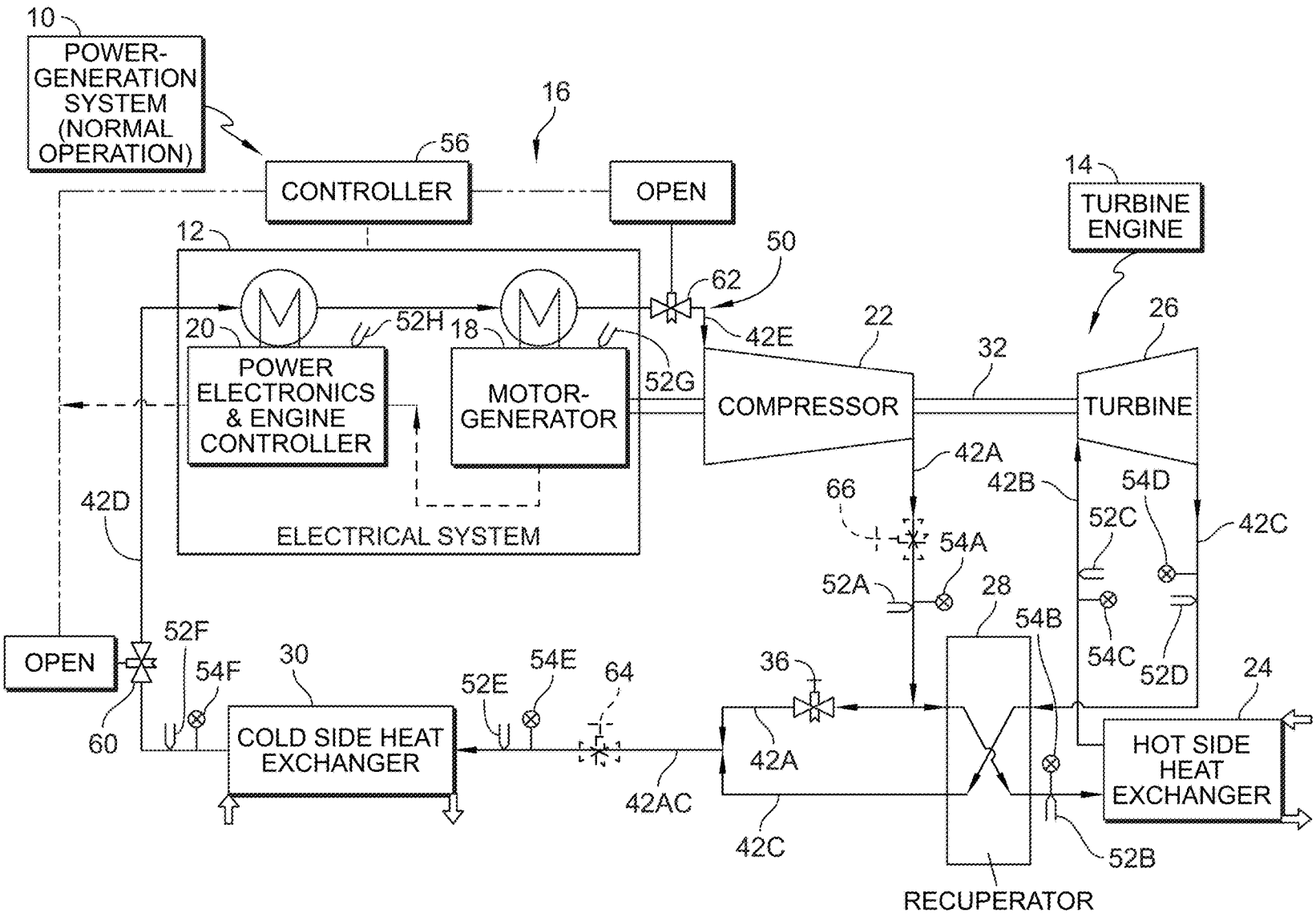
FIG. 1 is a diagrammatic view of a power-generation system according to the present disclosure, the system includes an electrical system, a turbine engine, and a fluid control system fluidly connected with the electrical system and the turbine engine to circulate the working fluid through the electrical system and the components of the turbine engine, and further showing the fluid control system includes a valve system upstream and downstream of the electrical system and a controller coupled to the valve system to control switching the valve system between an open mode as shown in FIG. 2 and a closed mode as shown in FIG. 3.

For the purposes of promoting an understanding of the principles of the disclosure, reference will now be made to a number of illustrative embodiments illustrated in the drawings and specific language will be used to describe the same.

Figure 2:
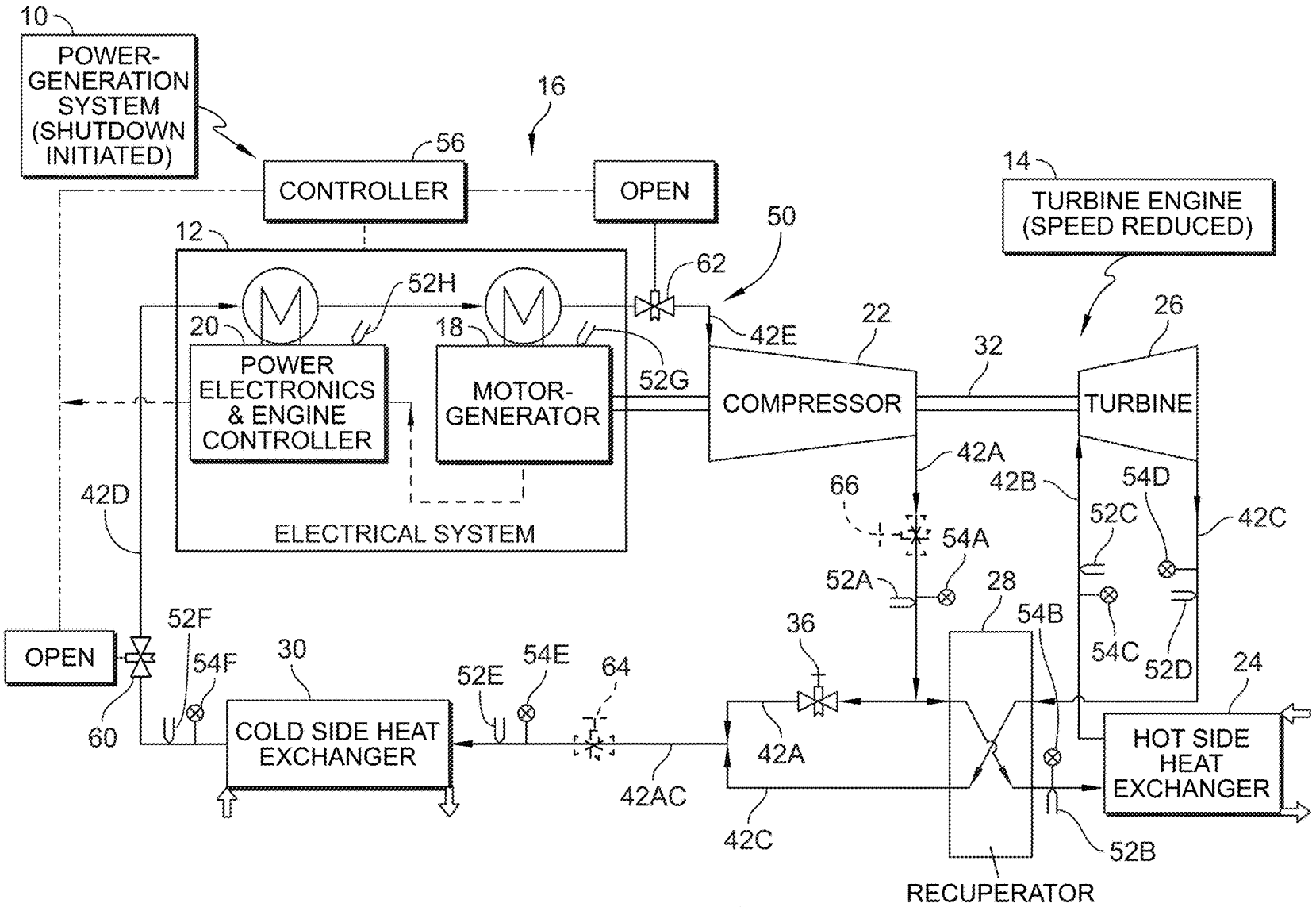
FIG. 2 is a diagrammatic view similar to FIG. 1 showing the system has changed from a normal operation mode as shown in FIG. 1 to a shutdown-initiated mode in which an operating speed of a compressor and a turbine of the turbine engine begins to slow down while the valve system remains in the open mode to allow cooled working fluid to flow into and out of the electrical system.
Figure 3:
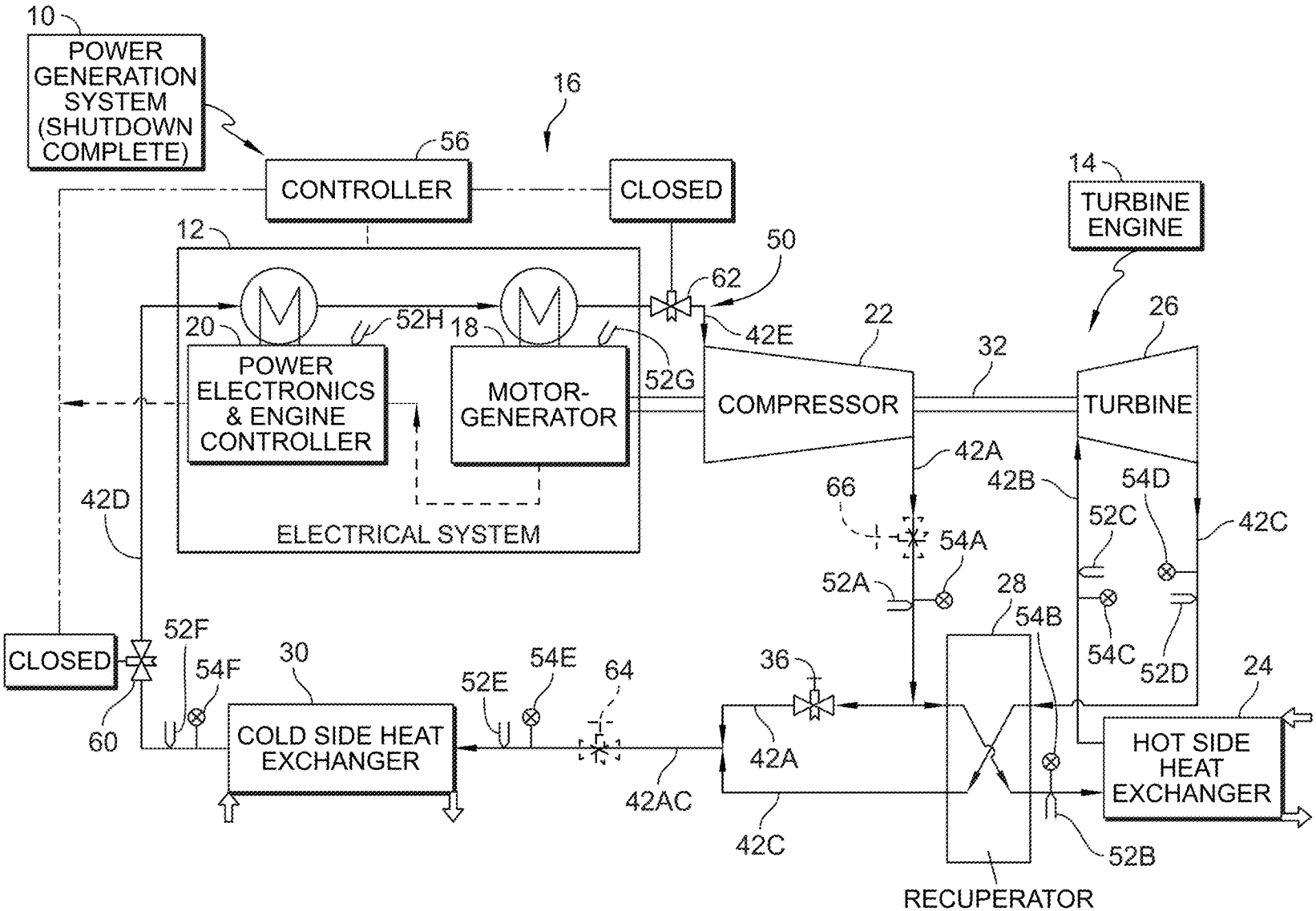
FIG. 3 is a diagrammatic view similar to FIG. 2 showing the system has changed from the shutdown-initiated mode to a shutdown-complete mode in which the operating speed of the compressor and turbine of the turbine engine is below a predetermined speed and the valve system changes to the closed mode in response to block the working fluid from flowing into and out of the electrical system.

An illustrative power-generation system 10 includes an electrical system 12, a turbine engine 14, and a fluid control system 16 fluidly connected with the electrical system 12 and the turbine engine 14 to circulate working fluid through the electrical system 12 and the turbine engine 14 as shown in FIGS. 1-3. The turbine engine 14 includes a compressor 22 that compresses a working fluid 42E to provide compressed working fluid 42A, a heat source 24, illustratively a reactor heat-exchanger 24, downstream of the compressor 22 that heats the compressed working fluid 42A to provide heated compressed working fluid 42B, and a turbine 26 downstream of the heat source 24 that extracts work from the heated compressed working fluid 42B to provide low-pressure working fluid 42C and drive rotation of the compressor 22.

In some embodiments, the turbine engine 14 includes an optional heat recuperator 28 that pre-heats the compressed working fluid 42A using heat from the low-pressure working fluid 42C, as shown in FIG. 1. The turbine engine 14 further includes a cooling heat-exchanger 30 arranged downstream of the turbine 26 that cools the low-pressure working fluid 42C received from the turbine 26 to provide cooled working fluid 42D.

The electrical system 12 is configured to produce electrical energy from the rotational power of the turbine engine 14 and/or convert the electrical energy into rotational power. The components of the electrical system 12 may have temperature limits such that the electrical system 12 is cooled during operation of the system 10. Other system have a separate dedicated cooling system for the electrical system 12. This allows the temperature of the electrical system 12 to be independently controlled, but adds components and complexity to the overall system.

To minimize components and secondary cooling systems, the electrical system 12 of the present application is located downstream of the cooling heat-exchanger 30 and configured for fluid cooling for removing heat from the electrical system 12. In this way, the cooled working fluid 42D from the cooling heat-exchanger may be used to cool the electrical system 12. During steady state operation, the cooling heat-exchanger 30 lowers the working fluid temperatures to an acceptable range to cool the whole system 10 as well as the electrical system 12.

The ability to pass the cooled working fluid across the electrical system 12 is maintained while the turbomachinery operating and moving fluid throughout the system 10. During a shutdown, the speed of the compressor 22 and the turbine 26 drops below a predetermined speed as the turbine engine 14 comes to a stop. Upon shutdown of the turbine engine 14, the system 10 will tend towards an equilibrium temperature with higher temperature and pressure states (e.g., within the turbine 26) dominating the overall equilibrium. This is due to the significantly higher volume of fluid at high temperatures rather than lower temperatures. Without the system 10 operating, the cooling capabilities may be minimized or eliminated such that sufficient heat is not rejected from the electrical system 12 to the working fluid or excessive heat from the working fluid is transferred to the electrical system.

The equilibrium temperature may be higher than acceptable or desired operating temperatures of the electrical system 12. Therefore, the fluid control system 16 is fluidly connected with the electrical system 12 and the turbine engine 14 to circulate the working fluid through the electrical system 12 and the turbine engine 14. The fluid control system 16 controls the flow of the working fluid through the electrical system 12 and the turbine engine 14 in order to prevent the delicate power conversion equipment of the electrical system 12 from being exposed to these high temperatures during shutdown.

The fluid control system 16 of the present disclosure is adapted to thermally protect the electrical system 12 during and after shutdown of the system 10. In the illustrative embodiment, the fluid control system 16 fluidly and thermally isolates the electrical system 12 from a majority of the working fluid during and after shutdown. As a result, the heat of the electrical system 12 and the heat of a portion of the isolated working fluid are generally the only heat sources acting on the electrical system 12 and no additional heat from the remainder of the working fluid (typically having the higher equilibrium temperature) is interacting with the electrical system 12.

The fluid control system 16 includes a valve system 50 and a controller 56 coupled to the valve system 50 as shown in FIGS. 1-3. The valve system 50 is configured to change between an open mode as shown in FIGS. 1-2 and a closed mode as shown in FIG. 3. In the open mode, the valve system 50 allows the cooled working fluid to flow through the electrical system 12 in response to operation of the turbine engine 14. In the closed mode, the valve system 50 blocks the working fluid from flowing through the electrical system 12.

In this way, the electrical system 12 is isolated from the rest of the working fluid in the system 10. As the rest of the working fluid approaches the high equilibrium temperature, the working fluid around the electrical system 12 remains at a lower temperature. This maintains the electrical system 12 within the desired temperature thresholds and shields it from exposure to the high-temperature working fluid after the shutdown.

In the illustrative embodiment, the valve system 50 includes a first valve 60 located upstream of the electrical system 12 and a second valve 62 located downstream of the electrical system 12 as shown in FIGS. 1-3. The first valve 60 is fluidly connected upstream of the electrical system 12 and downstream of the cooling heat-exchanger 30. The second valve 62 is fluidly connected downstream of the electrical system 12 and upstream of the compressor 22.

The first and second valves 60, 62 are configured to change between an open position as shown in FIGS. 1-2 and a closed position as shown in FIG. 3. The valves 60, 62 are in the open position when the valve system 50 is in the open mode and the valves 60, 62 are in the closed position when the valve system 50 is in the closed mode. In the open position, the first valve 60 and the second valve 62 allow the cooled working fluid to flow into and out of the electrical system 12 to transfer heat from the motor-generator 18 and the power conditioning and distribution system 20. In the closed position, the first valve 60 and the second valve 62 block the working fluid from flowing into and out of the electrical system 12.

During normal operation, also referred to as steady-state operation, the controller 56 is configured to direct the valve system 50 to be in the open mode, i.e., the valves 60, 62 to be in the open position, to allow the working fluid 42D from the cooling heat-exchanger to flow into and out of the electrical system 12 to cool the components. During a shutdown of the turbine engine 14, in which a speed of the compressor 22 and the turbine 26 is below the predetermined speed, the controller 56 is configured to direct the valve system 50 to be in the closed mode, i.e., the valves 60, 62 to be in the closed position.

As a result, the first valve 60 and the second valve 62 trap a first portion of the cooled working fluid 42D between the first valve 60 and the second valve 62 so that the first portion of the working fluid 42D around the electrical system 12 is isolated from a remaining second portion of the working fluid in the system 10. As the second portion of the working fluid is already hot or approaches the high equilibrium temperature after the shutdown, the working fluid around the electrical system 12 remains at a relatively lower temperature. This prevents exposing the electrical system 12 to the high-temperature working fluid after the shutdown of the system 10.

With an initial description of the system 10 provided above, the system 10 is hereafter described in further detail. The electrical system 12 includes a motor-generator 18 and an electric power conditioning and distribution system 20 as shown in FIGS. 1-3. The motor-generator 18 of the electrical system 12 is coupled with the turbine engine 14 and operable in a power-generation mode to produce electrical energy and a motor mode to convert the electrical energy into rotational power. The motor-generator 18 operates in the motor mode to start the turbine engine 14 and operates in the power-generation mode to be driven by the turbine engine 14 and generate the electrical energy. In this way, the heat from the heat source 24 may be used to generate electrical energy. The power conditioning and distribution system 20 may supply electrical energy to auxiliary systems. The power conditioning and distribution system 20 may supply electrical energy to auxiliary systems.

The turbine engine 14 includes the compressor 22, the heat source or reactor heat-exchanger 24, the turbine 26, the heat recuperator 28, and the cooling heat-exchanger 30 as shown in FIGS. 1-3. The reactor heat-exchanger 24 is also sometimes referred to as the hot side heat-exchanger 24. The cooling heat-exchanger 30 is also sometimes referred to as the cold side heat-exchanger 30.

The compressor 22 of the turbine engine 14 compresses the working fluid 42E to provide the compressed working fluid 42A, as shown in FIGS. 1-3. From the compressor 22, the compressed working fluid 42A is conducted toward the heat recuperator 28 and the reactor heat-exchanger 24. A portion of the compressed working fluid 42A may also be conducted from the outlet of the compressor 22 toward the cooling heat-exchanger 30 via a bypass valve 36 if operating conditions (pressure, temperatures, etc.) are met.

The compressed working fluid 42A flows from an outlet of the compressor 22, through the heat recuperator 28, and to the heat source 24. In the illustrative embodiment, the compressed working fluid 42A flows from the outlet of the compressor 22, through the heat recuperator 28, and to the reactor heat-exchanger 24, as shown in FIGS. 1-3. The reactor heat-exchanger 24 transfers heat from a nuclear reactor 25 to the compressed working fluid 42A to provide heated compressed working fluid 42B.

In the illustrative embodiment, the reactor heat-exchanger 24 is fluidly coupled with the nuclear reactor 25 to transfer heat from a hot fluid of the nuclear reactor 25 to the compressed working fluid 42A. In other embodiments, other heat sources may be used to heat the compressed working fluid 42A.

The heated compressed working fluid 42B from the reactor heat-exchanger 24 is conducted to an inlet of the turbine 26, as shown in FIGS. 1-3. The turbine 26 extracts work from the heated compressed working fluid 42B to drive the compressor 22 and the motor-generator 18 through a shaft 32. The compressor 22 and the motor-generator 18 are directly driven by the turbine 26 in the illustrative embodiment. In other embodiments, the compressor 22 and/or the motor-generator 18 are indirectly driven by the turbine 26 via transmissions, gearboxes, additional generator/battery systems, etc.

In the illustrative embodiment, from an outlet of the turbine 26, a low-pressure working fluid 42C flows to the heat recuperator 28, as shown in FIGS. 1-3. The heat recuperator 28 is arranged between the compressor 22 and the reactor heat-exchanger 24. The heat recuperator 28 receives the low-pressure working fluid 42C from the turbine 26 and transfers heat from the low-pressure working fluid 42C to the compressed working fluid 42A passing from the compressor 22 to the reactor heat-exchanger 24. Thus, heat is transferred to the compressed working fluid 42A in each of the heat recuperator 28 (via the low-pressure working fluid 42C) and the reactor heat-exchanger 24 (via the hot fluid of the nuclear reactor 25) before the heated compressed working fluid 42B flows to the inlet of the turbine 26. In other embodiments, the heat recuperator 28 is omitted.

The low-pressure working fluid 42C flows from the heat recuperator 28 to the cooling heat-exchanger 30, as shown in FIGS. 1-3. The cooling heat-exchanger 30 is located downstream of the turbine 26 and the heat recuperator 28. The cooling heat-exchanger 30 may also receive a portion of the compressed working fluid 42A from the outlet of the compressor 22 depending on the position of the bypass valve 36. The cooling heat-exchanger 30 transfers heat away from the working fluid 42AC via a cooling fluid flowing through the cooling heat-exchanger 30.

Cooled working fluid 42D exits the cooling heat-exchanger 30 and flows toward the electrical system 12 and the compressor 22, as shown in FIGS. 1-3. The electrical system 12 transfers heat to the cooled working fluid 42D. The working fluid 42E then flows to the compressor 22 where it is compressed to provide compressed working fluid 42A, and the compressed working fluid 42A recirculates through the cycle of the turbine engine 14. Thus, the system 10 is a closed-loop system where the working fluid is recirculated through the system 10.

The fluid control system 16 includes the valve system 50, a plurality of sensors 52A-H, 54A-F, and the controller 56 coupled to the valve system 50 and the sensors 52A-H, 54A-F as shown in FIGS. 1-3. The valve system 50 includes the first and second valves 60, 62 located upstream and downstream of the electrical system 12 to control the flow of the working fluid to the electrical system 12. The plurality of sensors 52A-H, 54A-F includes temperature sensors 52A-F configured to measure a temperature of the working fluid in the system 10, temperature sensors 52G, 52H configured to measure the temperature of the electrical system 12, and pressure sensors 54A-F configured to measure the pressure of the working fluid in the system 10.

The valve system 50 includes the first valve 60 and the second valve 62 as shown in FIGS. 1-3. The first valve 60 is upstream of the electrical system 12 and the second valve 62 is downstream of the electrical system 12. The first valve 60 is fluidly connected upstream of the electrical system 12 and downstream of the cooling heat-exchanger 30. The second valve 62 is fluidly connected downstream of the electrical system 12 and upstream of the compressor 22.

In some embodiments, the first valve 60 may instead be fluidly connected upstream of the electrical system 12 and upstream of the cooling heat-exchanger 30. In some embodiments, the second valve 62 may instead be fluidly connected downstream of the electrical system 12 and downstream of the compressor 22. In some embodiments, the valve system 50 may include a third valve 64 and a fourth valve 66 in addition to the first valve 60 and the second valve 62. The third valve 64 may be fluidly connected upstream of the electrical system 12 and upstream of the cooling heat-exchanger 30 and the fourth valve 66 may be fluidly connected downstream of the electrical system 12 and downstream of the compressor 22.

In some embodiments, the first valve 60 may instead be fluidly connected upstream of the cooling heat-exchanger 30 and the second valve 62 may instead be fluidly connected downstream of the compressor 22. In some embodiments, the valve system 50 may include a third valve 64 and a fourth valve 66 in addition to the first valve 60 and the second valve 62 like as suggested in FIGS. 1-3. The first valve 60 may remain fluidly coupled upstream of the cooling heat-exchanger 30 and the second valve 62 may remain fluidly coupled upstream of the compressor 22, while the third valve 64 may be fluidly connected upstream of the electrical system 12 and upstream of the cooling heat-exchanger 30 and the fourth valve 66 may be fluidly connected downstream of the electrical system 12 and downstream of the compressor 22 like as suggested in FIGS. 1-3.

The plurality of sensors 52A-H, 54A-F includes a first temperature sensor 52A, a second temperature sensor 52B, a third temperature sensor 52C, a fourth temperature sensor 52D, a fifth temperature sensor 52E, and a sixth temperature sensor 52F as shown in FIGS. 1-4. The first temperature sensor 52A is positioned downstream of the compressor 22 and upstream of the recuperator 28. The second temperature sensor 52B is positioned downstream of the recuperator 28 and upstream of the reactor heat-exchanger 24. The third sensor 52C is positioned downstream of the reactor heat-exchanger 24 and upstream of the turbine 26. The fourth sensor 52D is positioned downstream of the turbine 26 and upstream of the recuperator 28. The fifth sensor 52E is positioned upstream of the cooling heat-exchanger 30 and downstream of the recuperator 28 and the compressor. The sixth sensor 52F is positioned downstream of the cooling heat-exchanger 30 and upstream of the electrical system 12.

The plurality of sensors 52A-H, 54A-F includes a seventh sensor 52G and an eighth sensor 52H as shown in FIGS. 1-3. The seventh sensor 52G is in thermal communication with the motor-generator 18 of the electrical system 12 to measure the temperature of the motor-generator 18. The eighth sensor 52H is in thermal communication with the power conditioning and distribution system 20 of the electrical system 12 to measure the temperature of the power conditioning and distribution system 20.

The plurality of sensors 54A-F, 54A-F includes a first pressure sensor 54A, a second pressure sensor 54B, a third pressure sensor 54C, a fourth pressure sensor 54D, a fifth pressure sensor 54E, and a sixth pressure sensor 54F. The first pressure sensor 54A is positioned downstream of the compressor 22 and upstream of the recuperator 28. The second pressure sensor 54B is positioned downstream of the recuperator 28 and upstream of the reactor heat-exchanger 24. The third sensor 54C is positioned downstream of the reactor heat-exchanger 24 and upstream of the turbine 26. The fourth sensor 54D is positioned downstream of the turbine 26 and upstream of the recuperator 28. The fifth sensor 54E is positioned upstream of the cooling heat-exchanger 30 and downstream of the recuperator 28 and the compressor. The sixth sensor 54F is positioned downstream of the cooling heat-exchanger 30 and upstream of the electrical system 12.

The controller 56 is coupled to the valve system 50 to move the valve system 50 between the open mode as shown in FIGS. 1 and 2 and the closed mode as shown in FIG. 3. In the open mode, the valve system 50 allows the cooled working fluid to flow through the electrical system 12. In other words, in the open mode, the valves 60, 62 are in the open position to allow the working fluid to flow into and out of the electrical system 12. In the closed mode, the valve system 50 blocks the working fluid from flowing through the electrical system. In other words, in the closed mode, the valves 60, 62 are in the closed position to block the working fluid from flowing into and out of the electrical system 12.

The controller 56 is coupled to the valves 60, 62 of the valve system 50 to direct the valves 60, 62 to change between the open position to allow the working fluid to flow to and from the electrical system 12 and the closed position to block the working fluid to flow to and from the electrical system 12. The controller 56 is also coupled to the sensors 52A-H, 54A-F. The controller 56 is coupled to the sensors 52A-H, 54A-F to receive measurement information from the sensors 52A-H, 54A-F regarding the temperature of the working fluid, the temperature of the electrical system 12, and the pressure of the working fluid.

Instead of having a dedicated cooling system for the electrical system 12, the electrical system 12 is positioned downstream of the cooling heat-exchanger 30 of the system 10 so that the cooled working fluid 42D from the cooling heat-exchanger cools the electrical system 12. The valves 60, 62 are positioned upstream and downstream of the electrical system 12 to trap a first portion of the cooled working fluid 42D between the first valve 60 and the second valve 62 so that the portion of the working fluid 42D is isolated from the remaining second portion of the working fluid in the system 10. This maintains the electrical system 12 at the desired temperature while the system comes to an equilibrium temperature and shields the electrical system 12 from exposure to high-temperature working fluid.

The controller 56 directs the valve system 50 to change between the open and closed modes based on the operation of the system 10. In other words, the controller 56 directs the valves 60, 62 to change between the open and closed positions based on the operation of the system 10. During start-up of the turbine engine 14, the controller 56 directs the valves 60, 62 to be in the open position, i.e., the valve system 50 to be in the open mode.

The controller 56 directs the valve system 50 to be in the open mode, i.e., the valves 60, 62 to be in the open position, in response to operation of the turbine engine 14. In a normal operation mode, the turbine engine 14 is running at a sufficient speed to provide cool air to the cold side volume of the system 10. Therefore, while the turbine engine 14 is running, the controller 56 may direct the valves 60, 62 to be in the open position.

A shutdown may be initiated for multiple reasons. In some embodiments, a user may direct the system 10 to initiate a shutdown. In some embodiments, the shutdown may be initiated based on the measurements from the plurality of sensors 52A-H, 54A-F.

Once a shutdown sequence is initiated, the turbine inlet temperature is lowered to the lowest value possible to maintain a self-sustaining cycle with the working fluid still circulating in the system 10. The speed of the turbine engine 14 is reduced to lowest value possible which to lower exit temperature of the compressor 22 and to lower inlet temperature of the cooling heat-exchanger 30. As turbine engine 14 comes to a stop, the speed of the compressor 22 and the turbine 26 drops below a predetermined speed.

The controller 56 directs the valve system 50 to be in the closed mode, i.e., the valves 60, 62 to be in the closed position in response to a shutdown of the turbine engine 14. In other words, the controller 56 directs the valves 60, 62 to be in the closed position in response to a speed of the compressor 22 and the turbine 26 being below the predetermined speed.

In some embodiments, the predetermined speed is greater than zero or before the turbine engine 14 comes to a full stop. In some embodiments, the predetermined speed is zero or when the turbine engine 14 reaches a full stop. In some embodiments, the controller 56 may direct the valves 60, 62 to be in the closed position in response to a temperature measurement from one of the sensors 52A-H during a shutdown.

In the closed mode, the first and second valves 60, 62 block the working fluid from flowing to the electrical system 12 to trap the first portion of the working fluid between the first valve 60 and the second valve 62. In this way, the electrical system 12 is isolated from the remaining second portion of the working fluid in the system 10 to prevent the electrical system 12 from being exposed to high-temperature working fluid after the shutdown.

The total working fluid temperature, or the equilibrium temperature, is higher than the operating temperature limits of the power electronics of the electrical system 12. The hot side of the system 10, which includes the reactor heat-exchanger 24, the turbine 26, and the recuperator 28, is at a higher temperature at shutdown than the cold side of the system 10, which includes the cooling heat-exchanger 30 and the electrical system 12. Isolating the cold side of the system 10 using the fluid control system 16 helps keep temperatures within nonoperational electric component limits.

A method of operating the system 10 may include several steps. The method includes compressing a working fluid with the compressor 22, heating the compressed working fluid, and rotating the turbine 26 with the heated working fluid. The method further includes cooling the heated working fluid after rotating the turbine 26 with the heated fluid and cooling at least one electrical component with the cooled working fluid. The system 10 is a closed-loop power generation system 10 such that the working fluid is recirculated through the system 10. Therefore, the method further includes conducting the working fluid from the at least one electrical component to the compressor 22.

The method also includes conducting electrical energy to at least one electrical component of the electrical system 12. The method also includes driving the motor-generator 18 with the work extracted from the turbine 26 to produce the electrical energy. The method also includes converting the electrical energy into rotational power to start the turbine engine 14.

The method also includes blocking the working fluid from flowing to the electrical component of the electrical system 12 in response to a speed of the compressor 22 and the turbine 26 being below a predetermined speed. The step of blocking the working fluid from flowing to the at least one electrical component of the electrical system 12 includes shutting the first valve 60. The step of blocking the working fluid from flowing to the at least one electrical component of the electrical system 12 may also include shutting the second valve 62.

Closed Brayton cycle systems may be used for terrestrial or space satellite power generation using nuclear reactions. Closed Brayton cycle systems may be used with a nuclear reactor to provide a combustion heat source. Closed Brayton cycle systems may be more efficient at converting nuclear reactor heat to electric power than traditional methods such as a radioisotope generator converting heat to power.

Due to the harsh environment around space and other terrestrial uses, it may be difficult to service the hardware and long component life is desirable. It may be advantageous to keep electrical components cool for improved reliability. Cooled working fluid may be used to maintain long-life operating temperatures of motor-generator and power conditioning and distribution systems.

There are temperature limits for typical electrical components used to convert mechanical energy into electrical power, including both the power electronics and/or the alternator/generator. To minimize components and secondary cooling systems the thermal management of the power conversion system may, during steady state operation, be maintained by the working fluid passing across power conversion cooling systems after passing through the cooling heat-exchanger 30 of the system 10. The cooling heat-exchanger 30 lowers the temperature of the working fluid to an acceptable range for the electronic system 12.

The ability to pass the desired cool working fluid across the power conversion system may only be maintained while the turbomachinery is moving fluid throughout the system. Upon shut down of the turbomachinery, the closed system will tend towards an equilibrium temperature with the higher temperature and pressure states (e.g., within the turbine) dominating the overall equilibrium. This is due to the significantly higher volume of fluid at high temperatures rather than lower temperatures. The equilibrium temperature is significantly higher than the operating temperature limits of the power electronics.

The fluid control system 16 is configured to prevent the delicate power conversion equipment from being exposed to these temperatures during shutdown. The fluid control system 16 includes the valve system 50 with a valve 60 located upstream of the electrical system 12 and a valve 62 at the exit of the electrical system 12. This is in lieu of using outside energy source(s) to motor the turbomachinery below the self-sustainment speeds.

While the engine 14 is running, providing sufficiently cool air to the cold side volume including the electrical system 12, the valve system 50 is in the open mode. A shutdown sequence is then initiated such that turbine inlet temperature is lowered to the lowest value possible to maintain a self-sustaining cycle with fluid still flowing. The system operating speed is reduced to lowest value possible, which lowers the compressor exit temperature and lowers the cold side heat exchanger inlet temperature. As turbomachinery comes to a stop, the valve system is changed to the closed mode. The closing of the valves 60, 62 prevents the hot working fluid from washing over the electronic components of the electrical system 12.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A power-generation system comprising:

an electrical system including a motor-generator and an electric power conditioning and distribution system connected with the motor-generator, the motor-generator operable in a power-generation mode to produce electrical energy and a motor mode to convert the electrical energy into rotational power, and the electrical system configured for fluid cooling for removing heat from the electrical system, a turbine engine including a compressor configured to receive a working fluid and compress the working fluid to provide a compressed working fluid, a reactor heat-exchanger downstream of the compressor that transfers heat from a nuclear reactor to the compressed working fluid to provide a heated working fluid, a turbine downstream of the reactor heat-exchanger and configured to extract work from the heated working fluid and drive rotation of the compressor and the motor-generator, and a cooling heat-exchanger downstream of the turbine to transfer heat away from the heated working fluid to provide a cooled working fluid, and a fluid control system fluidly connected with the electrical system and the turbine engine to circulate the working fluid through the electrical system and the turbine engine, the fluid control system including a first valve located upstream of the electrical system, a second valve located downstream of the electrical system, and a controller coupled to the first valve and the second valve, the first valve and the second valve each being configured to change between an open position in which the first valve and the second valve allow the cooled working fluid to flow into and out of the electrical system to transfer heat from the motor-generator and the power conditioning and distribution system and a closed position in which the first valve and the second valve block the working fluid from flowing into and out of the electrical system, wherein the controller is configured to direct the first valve and the second valve to change from the open position to the closed position in response to a shutdown of the turbine engine in which a speed of the compressor and the turbine is below a predetermined speed to trap a first portion of the working fluid between the first valve and the second valve so that the electrical system is isolated from a second portion of the working fluid in the system to prevent the electrical system from being exposed to a high-temperature of the second portion of the working fluid after the shutdown.

2. The power-generation system of claim 1, wherein the power-generation system is a closed-loop system such that the working fluid is recirculated through the power-generation system.

3. The power-generation system of claim 1, wherein the first valve is fluidly connected upstream of the electrical system and downstream of the cooling heat-exchanger.

4. The power-generation system of claim 1, wherein the first valve is fluidly connected upstream of the cooling heat-exchanger.

5. The power-generation system of claim 1, wherein the second valve is fluidly connected downstream of the electrical system and upstream of the compressor.

6. The power-generation system of claim 1, wherein the second valve is fluidly connected downstream of the compressor.

7. The power-generation system of claim 1, wherein the motor-generator is coupled with the turbine engine and configured to operate in the motor mode to start the turbine engine and to operate in the power-generation mode to be driven by the turbine and generate the electrical energy.

8. A power-generation system comprising:

an electrical system, a turbine engine including a compressor configured to receive a working fluid and compress the working fluid to provide a compressed working fluid, a heat source that transfers heat to the compressed working fluid to provide a heated working fluid, a turbine fluidly connected with the compressor to extract work from the heated working fluid and drive rotation of the compressor, and a first heat-exchanger fluidly connected with the turbine to transfer heat away from the heated working fluid to provide a cooled working fluid, and a fluid control system including a valve system and a controller coupled to the valve system to move the valve system between an open mode in which the valve system allows the cooled working fluid to flow through the electrical system in response to operation of the turbine engine and a closed mode in which the valve system blocks the working fluid from flowing through the electrical system in response to a shutdown of the turbine engine.

9. The power-generation system of claim 8, wherein the controller is configured to direct the valve system to be in the open mode at a start-up of the turbine engine to allow the working fluid to flow through the system.

10. The power-generation system of claim 8, wherein the valve system includes a first valve fluidly connected upstream of the electrical system and downstream of the first heat-exchanger.

11. The power-generation system of claim 10, wherein the valve system further includes a second valve fluidly connected downstream of the electrical system and upstream of the compressor.

12. The power-generation system of claim 10, wherein the valve system further includes a second valve fluidly connected downstream of the compressor.

13. The power-generation system of claim 8, wherein the valve system includes a first valve fluidly connected upstream of the first heat-exchanger.

14. The power-generation system of claim 12, wherein the valve system further includes a second valve fluidly connected downstream of the electrical system and upstream of the compressor.

15. The power-generation system of claim 12, wherein the valve system further includes a second valve fluidly connected downstream of the compressor.

16. The power-generation system of claim 9, wherein the electrical system includes a motor-generator coupled with the compressor and configured to operate in a motor mode to start the turbine engine and to operate in a power-generation mode to be driven by the turbine and generate electrical energy.

17. A method of operating a power-generation system, the method comprising:

compressing a working fluid with a compressor, heating the compressed working fluid, rotating a turbine with the heated working fluid, cooling the heated working fluid after rotating the turbine with the heated fluid, conducting electrical energy to at least one electrical component, cooling at least one electrical component with the cooled working fluid, conducting the working fluid from the at least one electrical component to the compressor, and blocking the working fluid from flowing to the electrical component in response to a speed of the compressor and the turbine being below a predetermined speed.

18. The method of claim 17, wherein blocking the working fluid from flowing to the at least one electrical component includes shutting a first valve fluidly connected upstream of the at least one electrical component and downstream of the turbine.

19. The method of claim 18, wherein blocking the working fluid from flowing to the at least one electrical component includes shutting a second valve fluidly connected downstream of the at least one electrical component and upstream of the turbine.

20. The method of claim 17, further comprising driving a generator with the work extracted from the turbine to produce the electrical energy.

* * * * *